United States Patent [19]

Snyder, Jr. et al.

[11] Patent Number: 4,462,920

[45] Date of Patent: Jul. 31, 1984

[54] WATER-BASED HYDRAULIC FLUIDS

[75] Inventors: Kenneth L. Snyder, Jr.; Kenneth L. Foster, both of Midland, Mich.

[73] Assignee: The Dow Chemical Company, Midland, Mich.

[21] Appl. No.: 501,345

[22] Filed: Jun. 6, 1983

[51] Int. Cl.[3] ..... C10M 3/04; C10M 3/12

[52] U.S. Cl. ..... 252/75; 252/49.3; 252/49.5; 252/52 A; 252/56 R; 252/73; 252/74; 252/76; 252/77; 252/78.5; 252/79; 526/287

[58] Field of Search ..... 252/49.3, 49.5, 52 A, 252/56 R, 73, 74, 75, 76, 77, 78.5, 79; 526/287

[56] References Cited

U.S. PATENT DOCUMENTS

| | | | |
|---|---|---|---|
| 3,177,146 | 4/1965 | Francis | 252/49.5 |
| 3,284,393 | 11/1966 | Vanderhoff et al. | 526/287 |
| 3,361,669 | 1/1968 | van Westen et al. | 252/18 |
| 3,652,497 | 3/1972 | Junas et al. | 525/190 |
| 3,794,608 | 2/1974 | Evani et al. | 524/517 |
| 4,008,202 | 2/1977 | Evani et al. | 526/287 |
| 4,029,873 | 6/1977 | Evani et al. | 525/449 |
| 4,029,874 | 6/1977 | Evani et al. | 526/304 |
| 4,038,265 | 7/1977 | Evani et al. | 524/521 |
| 4,061,684 | 12/1977 | Helfert et al. | 252/73 |
| 4,075,411 | 2/1978 | Dickstein | 524/43 |
| 4,080,304 | 3/1978 | Smith | 252/49.6 |
| 4,105,649 | 8/1978 | Evani et al. | 526/287 |
| 4,138,346 | 2/1979 | Nassry et al. | 252/45 |
| 4,151,099 | 4/1979 | Nassry et al. | 252/32.7 E |
| 4,257,902 | 3/1981 | Singer | 252/18 |
| 4,265,774 | 5/1981 | Langdon | 252/49.3 |
| 4,288,639 | 9/1981 | Camp | 568/625 |
| 4,303,537 | 12/1981 | Laepple et al. | 252/49.5 |
| 4,312,768 | 1/1982 | Nassry et al. | 252/32.7 E |
| 4,313,836 | 2/1982 | Nassry et al. | 252/32.7 E |
| 4,317,740 | 3/1982 | Eisenhard | 252/49.3 |
| 4,384,096 | 5/1983 | Sonnabend | 526/313 |

*Primary Examiner*—John E. Kittle
*Assistant Examiner*—Robert A. Wax

[57] ABSTRACT

Substantially oil-free aqueous industrial fluids possess superior lubricating and wear preventing characteristics and are useful as hydraulic fluids and metalworking compositions. Fluids of the invention comprise (1) an aqueous liquid and (2) a water-soluble synthetic addition polymer of (a) an ethylenically unsaturated cross-linking monomer, (b) an ethylenically unsaturated water-soluble monomer, (c) an ethylenically unsaturated water-insoluble monomer and (d) an ethylenically unsaturated polyalkyleneoxy-containing monomer.

The industrial fluids exhibit good Newtonian behavior and mechanical stability at high shear.

15 Claims, No Drawings

WATER-BASED HYDRAULIC FLUIDS

BACKGROUND OF THE INVENTION

This invention relates to water-based hydraulic and metalworking fluids, in particular those fluids which are thickened with a substantially water-swellable polymeric thickening agent.

Petroleum oils have traditionally been used as hydraulic fluids. Such oils exhibit good Newtonian viscosity behavior. A Newtonian fluid is a fluid that possesses a viscosity which is independent of the velocity gradient. Thus, the shear stress ($\tau$) is related to the shear rate ($\gamma$) by the equation:

$$\tau=\eta\gamma$$

wherein $\eta$ is the shear rate independent viscosity. Further, petroleum oils have a viscosity that is fairly constant throughout the lifetime of the fluid at prolonged high shear rates. This mechanical stability to shear degradation is a desired property of hydraulic fluids. The shear stable Newtonian viscosity of a typical hydraulic oil is generally in the range of 10 to 100 centistokes at 100° F.

Water-based lubricant products are gaining popularity due to shortages of petroleum base supplies, environmental concerns caused by problems in disposing of oil-based wastes, cost incentives and fire safety considerations. Typically, a water-based hydraulic fluid consists of several water-soluble or emulsifiable additives such as corrosion inhibitors (alkanolamines), lubricity aids (long chain carboxylic acid salts) and/or extreme pressure additives (zinc dialkyldithiophosphates, phosphate esters, borates, etc.). However, such an additive package has a viscosity that is essentially equal to that of water. It is desirable to thicken such a water-based lubricant with a substantially water-swellable thickening agent to overcome the problems associated with the use of a low viscosity fluid.

Increased viscosity of the water-based hydraulic fluids is desirable for several reasons. In particular, thickened fluid can aid in the operation of system valves which have been designed to work specifically with oil-based fluids. Further, thickened fluids are less prone to experience leaking though small holes or cracks in the hydraulic system. Higher pump efficiencies are obtainable with thickened fluids, especially at high loads, and such fluids exhibit wear prevention characteristics in both hydrodynamic and elastohydrodynamic wear modes. It is desirable to provide a viscosity which is relatively constant throughout the lifetime of the fluid and relatively constant at varying shear rates.

For water-based hydraulic fluids, a polymer solution having a mechanically stable viscosity of about 10 to about 100 centistokes at 100° F. and a viscosity independent of shear rate at shear rates approaching up to about $10^6\,\text{sec}^{-1}$ is desirable. One way of describing the viscosity dependence on shear rate is through the use of the Power Law:

$$\ln \tau=N \ln \dot{\gamma}+\ln K.$$

Here, the shear stress ($\tau$) is found to vary in a non-linear manner with shear rate ($\gamma$). Thus, the viscosity changes with changes in shear rate. N is a measure of the extent of deviations from Newtonian behavior. A Power Law N value of 1.0 indicates a Newtonian fluid. Anything less than 1.0 is said to be shear-thinning. The K value relates to the fluid viscosity at a shear rate of 1 $\text{sec}^{-1}$. Further, for the sake of economic efficiency, it is desirable to keep the polymer concentration as low as possible. However, it is not always possible to provide a polymer system that exhibits a desired, mechanically stable hydrodynamic size and the desired Newtonian viscosity while maintaining a high polymer thickening efficiency.

Water-soluble polymers can be made in a variety of physical structures and molecular weights. High molecular weight linear polymers are highly efficient thickeners. However, such polymers exhibit non-Newtonian viscosity behavior and suffer from mechanical degradation at high shear rates. Reduction in molecular weight of the linear polymers increases the Newtonian character and mechanical stability of the thickener. Unfortunately, such low molecular weight polymers require high concentrations to thicken the fluid and thus are not economical.

It is desirable to produce compositions which, at low concentrations, exhibit a substantial thickening effect on the water in the aqueous hydraulic systems formed thereby, and provide the aqueous system with high viscosity and enhanced shear stability. It is also desirable that the viscosities in the aqueous hydraulic fluid systems employing the thickeners approach the viscosities of oil-based hydraulic systems, i.e., about 10 to about 100 centistokes at 100° F.

SUMMARY OF THE INVENTION

This invention is a substantially oil-free hydraulic fluid or metalworking composition which maintains a Newtonian shear stable viscosity comprising an aqueous liquid and a functionally effective amount of a substantially water-swellable synthetic addition polymer comprising the polymerization product of at least one ethylenically unsaturated water-soluble monomer, at least one ethylenically unsaturated water-insoluble monomer, at least one ethylenically unsaturated polyalkyleneoxy-containing monomer, and at least one polyvinyl crosslinking monomer. Said synthetic addition polymer comprises the polymerization product of an amount of water-soluble monomer sufficient to provide swellability to the resulting polymerization product, an amount of water-insoluble monomer sufficient to control the degree of swellability of the resulting polymerization product, an amount of polyalkyleneoxy-containing monomer to impart thickening efficiency to the polymerization product as high shear rates while not suffering significant deformation, and an amount of crosslinking monomer sufficient to control the degree of swellability of the resulting polymerization product while imparting mechanical reinforcement to said polymerization product. As used herein, the term "aqueous liquid" means water or an aqueous solution comprising additives commonly employed in aqueous hydraulic fluids, such as corrosion inhibitors, anti-wear agents, etc. The compositions of matter of the present invention are thickened aqueous solutions which are pH responsive.

The hydraulic fluids and metalworking compositions of the present invention exhibit excellent lubricity and anti-wear characteristics, and are useful as coolants and lubricants of surfaces which are in frictional contact such as during operations of turning, cutting, peeling, grinding metals and the like. Such fluids and compositions are easily prepared, exhibit the desirable viscosities of oil-based hydraulic systems and maintain a relatively constant viscosity (i.e., provide a Newtonian shear stable viscosity) at high shear. As used herein, "high shear" means a shear rate of greater than about 1000 $sec^{-1}$. The hydraulic fluids and metalworking compositions are ecologically superior to those fluids and metalworking emulsions of the prior art containing petroleum oils, mineral oils or glycerol/water mixtures.

DETAILED DESCRIPTION OF THE INVENTION

Ethylenically unsaturated water-soluble monomers suitable for use in this invention are those which are sufficiently water-soluble to form at least about 5 weight percent solutions when dissolved in water and which readily undergo addition polymerization to form polymers which are at least inherently water-dispersible and preferably water-soluble. By "inherently water-dispersible" is meant that the polymer, when contacted with an aqueous medium, will disperse therein without the aid of surfactants to form a colloidal dispersion of the polymer in the aqueous medium. Said water-soluble monomers may be cationic, anionic or nonionic, with anionic and nonionic being most preferred. Such water-soluble monomers include acrylic acid, methacrylic acid, ethacrylic acid, crotonic acid, 2-chloroacrylic acid, 2-bromoacrylic acid, 3-chloroacrylic acid, 2-phenolacrylic acid, 3-phenolacrylic acid, vinylbenzoic acid, isopropenolbenzoic acid, and the like and salts thereof; sodium styrene sulfonate; sulfoethyl methacrylate; acrylamide, methacrylamide and the like; hydroxy-containing esters of $\alpha,\beta$-ethylenically unsaturated, aliphatic monocarboxylic acids such as $\beta$-hydroxypropyl methacrylate, 4-hydroxybutyl acrylate, 5-hydroxypentyl methacrylate, hydroxyethyl acrylate, hydroxypropyl acrylate, and the like; dicarboxylic acids or their anhydrides such as maleic anhydride, itaconic anhydride, citraconic anhydride, chloromaleic anhydride, fumaric acid, maleic acid, itaconic acid and the like or the half esters or half amides of said acids; ethylenimines and amino acrylates such as dimethylaminoethyl methacrylate; and acrylamido-2-methylpropane sulfonic acid. Ethylenically unsaturated quaternary ammonium compounds such as vinylbenzyltrimethylammonium chloride, N-trimethylammoniumpropyl methacrylamide chloride and trimethylammoniumethyl acrylamide chloride can also be employed. Monomers such as vinyl acetate may be used since the polymers may be hydrolyzed to produce the alcohol group. It is most preferable that the monomer be potentially water-soluble upon an increase in pH of the aqueous solution (i.e., greater than about 7). Of course, it is understood that in the case of a nonionic monomer; an anionic strong electrolyte, such as sodium styrene sulfonate; or a cationic strong electrolyte such as vinylbenzyltrimethyl ammonium chloride; the water solubility is essentially pH independent. It is also understood that in the case of a cationic monomer, which is much less preferred, the water solubility of said monomer will increase with a decrease in pH.

Of the aforementioned water-soluble monomers, the acid monomers such as acrylic acid and methacrylic acid are most preferred. Such monomers most readily introduce an alkali swellable characteristic to the resulting polymer due to the hydrophilicity provided by such a species at a pH of from about 5 to about 14, most preferably from about 7 to about 12. The water swellability provided to the polymer of this invention by said water-soluble monomers acts to increase the thickening efficiency of said polymer.

Ethylenically unsaturated water-insoluble monomers suitable for use in this invention are those which are sufficiently water-insoluble to introduce substantial hydrophobicity in the resulting polymer. Polymerization products of this invention require substantial hydrophobic character in order that the degree of swellability be controlled and, hence, said copolymer will not undergo substantial changes in its hydrodynamic volume during a change in shear rate. These monomers are well known in the art and, hence, are illustrated below only by representative examples. The nonionic ethylenically unsaturated monomers are represented by, but not restricted to, hydrocarbon monomers such as the styrene compounds, such as styrene, $\alpha$-methylstyrene, ar-methylstyrene, ar-ethylstyrene, $\alpha$,ar-dimethylstyrene, ar,ar-dimethylstyrene and t-butylstyrene; the hydrocarbon monomers which are modified to possess nonionic substituents, such as hydroxystyrene, methoxystyrene and cyanostyrene; the unsaturated alcohol esters such as vinyl acetate and vinyl propionate; the unsaturated olefins, such as ethylene; the unsaturated ketones, such as vinyl methyl ketone and methyl isopropenyl ketone; the unsaturated ethers, such as vinylethyl ether and vinyl methyl ether; and the nonionic derivatives of ethylenically unsaturated carboxylic acids such as acrylic esters which include methyl acrylate, ethyl acrylate, butyl acrylate, hexyl acrylate, 2-ethylhexyl acrylate and lauryl acrylate; methacrylic esters, such as methyl methacrylate, ethyl methacrylate; the maleic esters such as dimethyl maleate, diethyl maleate and dibutyl maleate; the fumaric esters, such as dimethyl fumarate, diethyl fumarate and dibutyl fumarate and the itaconic esters, such as dimethyl itaconate, diethyl itaconate and dibutyl itaconate; the nitriles, such as acrylonitrile and methacrylonitrile; and species such as cyclopentadiene acrylate. While not in the preferred class, nonionic monomers containing halogens which are not activated may be employed, such as monochlorostyrene, dichlorostyrene, vinyl fluoride, chloroprene, vinyl chloride, vinylidene chloride and the like.

The polyvinyl crosslinking monomers include, for example, divinyl benzene, diallyl esters of polycarboxylic acids, triallyl terephthalate, N,N'-methylene diacrylamide, diallyl maleate, diallyl fumarate, divinyl adipate, diallyl succinate, divinyl ether, the divinyl ethers of ethylene glycol or diethylene glycol diacrylate, polyethylene glycol diacrylates or methacrylates, the butylene glycol diacrylates or dimethacrylates, and the like. Of the aforementioned polyvinyl crosslinking monomers, those most preferred include allyl acrylate, allyl methacrylate, N,N'-methylene diacrylamide divinylbenzene.

The crosslinking monomer is present in the polymerization product in amounts sufficient to control the degree of swellability of said polymerization product while imparting mechanical reinforcement to said polymerization product. That is, the crosslinked structure so formed does not readily deform in a flow field to the extent that a random coil (i.e., linear polymer) does. In such a way the Newtonian character of the polymerization product is maximized. The structural reinforcements provided to the polymerization product by the crosslinking also serves to minimize the effect that mechanical degradation has on reducing hydrodynamic size. That is, it is necessary to break several backbone links of the polymerization product of this invention before any substantial change in hydrodynamic volume is observed. Conversely, one scission in the backbone of a linear polymer is enough to cause a substantial reduction in the hydrodynamic volume of said polymer. However, by limiting the degree of swellability of the polymerization product, the low shear rate viscosity of the polymeric thickener is minimized. This decreases the thickening efficiency of the polymer.

The polyalkyleneoxy-containing monomer is an ethylenically unsaturated monomer represented by the formula:

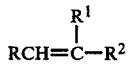

wherein R and $R^1$ are individually hydrogen, methyl, ethyl, propyl, butyl or other such lower alkyl; COOX wherein X is hydrogen or a lower alkyl; $—CH_2COOX$; halo or alkylhalo (halo is chloro or bromo), nitrile, $—C_6H_4Y$ wherein Y is hydrogen lower alkyl or halo; $—NH_2$ or alkylamine. $R^2$ is represented by $—A(R^3O)_n—R^4$ wherein A is a suitable linking moiety such as —O—, —NH—, —S—,

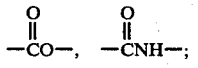

aryl or a lower alkyl substituted aryl; aralkyl such as

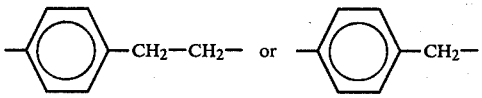

or lower alkyl such as $—CH_2—$ or $—CH_2CH_2—$. Alternatively, A may be absent. $R^3$ is lower alkyl, namely, ethyl, propyl, isopropyl, and the like or combinations thereof; and n is an integer between 1 and 100, most preferably between 5 and 40. $R^4$ is hydrogen, alkyl or branched alkyl wherein the alkyl contains between 1 and about 8 carbon atoms; or

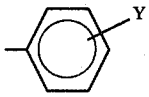

wherein Y is hydrogen or an alkyl containing between 1 to about 3 carbon atoms, or

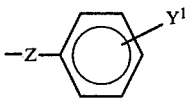

wherein Z and $Y^1$ are lower alkyl such that the number of carbon atoms comprising Z and $Y^1$ is in the range from 1 to about 3.

One of the especially preferred polyalkyleneoxy-containing monomers are the acrylate and methacrylate esters such as:

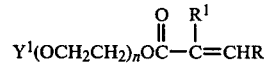

wherein R and $R^1$ are H or $CH_3$; $Y^1$ is hydrogen or an alkyl containing between 1 and about 9 carbon atoms, and n is about 4 to about 100. An especially preferred member of this class is decaethyleneglycol monomethacrylate.

These preferred polyalkyleneoxy containing monomers are the acrylic or methacrylic acid esters of certain nonionic surfactant alcohols. Such esters are known in the art. For example, Junas et al., U.S. Pat. No. 3,652,497 describe the use of alkylphenoxyethyleneoxyethyl acrylates in preparing several other polymeric surfactant thickeners. Dickstein, U.S. Pat. No. 4,075,411 describes several processes for preparing such vinyl surfactant esters including the acid catalyzed condensation of commercially available nonionic polyoxyalkylene surfactant alcohols such as alkylphenoxypoly(ethyleneoxy)alcohol and block-polymeric glycols with acrylic, methacrylic, crotonic, maleic, fumaric, itaconic or aconitic acid. Alternate esterification methods including alcoholysis and transesterification are also described.

Other especially preferred polyalkyleneoxy-containing monomers are ethers such as vinyl benzyl ethers:

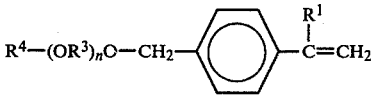

wherein $R^1$ is H or $CH_3$; $R^3$ is as defined hereinbefore, preferably ethylene; $R^4$ is hydrogen or an alkyl as defined hereinbefore or

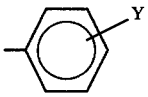

wherein Y is hydrogen or an alkyl containing between 1 and about 9 carbon atoms; and n is about 5 to about 100, most preferably 5 to 40. These monomers are known in the art. For example, Evani et al., U.S. Pat. Nos. 4,029,873 and 4,028,874 describe the use of such vinyl benzyl ethers in preparing surfactant thickeners. In addition, said patents disclose processes for preparing such vinyl benzyl ethers by reacting vinyl benzyl halides and nonionic surfactants prepared from the condensation of alkylene oxides.

The use of an ether or amide linkage for attaching the side chain-type monomers may be preferred over the use of esters since the ester may present a potential hydrolytic stability problem. Amides and ethers are known to be more hydrolytically stable.

Examples of amide types of side chains which may be used are:

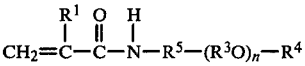

wherein $R^1$, $R^3$, $R^4$ and n are as previously defined, and $R^5$ is a suitable connecting fragment such as, for example, —$CH_2$—. Preferably $R^1$ is hydrogen or methyl and $R^3$ is ethylene. This type of monomer may be made through the reaction of surfactant alcohols with N-methylol acrylamide. The preparation of N-methylol acrylamide is taught in U.S. Pat. No. 3,064,050, which is incorporated herein by reference. For example, various polyglycols can be employed in an etherification reaction to obtain the amide functionalized surfactant-type vinyl monomers. Such monomers are readily copolymerized through their vinyl functionalities.

The polyalkyleneoxy-containing monomer introduces to the polymer a hydrophilic side chain of from about 1 to about 100 alkyleneoxy units terminated with hydrogen or a hydrophobic moiety. An increased length of the polyalkyleneoxy moiety will increase the solubility of the resulting polymeric thickener in water. However, an increased length beyond some optimum value of the polyalkyleneoxy moiety does not necessarily improve the shear stability of the resulting hydraulic fluid or metalworking composition. This is because the side chains are becoming so long that they are subject to mechanical degradation and temporary non-Newtonian types of deformations.

The hydrophobic moiety that terminates the hydrophilic polyalkyeneoxy side chain provides a surfactant character to the resulting polymer. However, it is necessary to maintain the composition of said hydrophobic moiety within the aforementioned range in order to provide a polymeric thickener which exhibits good Newtonian behavior. That is, if the hydrophobic moiety is larger than the range previously specified, it is possible that hydrophobic association between the terminating moeties of adjacent polymer molecules at low shear imparts a non-Newtonian behavior upon the resulting hydraulic fluid or metalworking compositions.

The polymerization may be carried out batchwise, stepwise or continuously with batch and/or continuous addition of monomers and/or reagents in a conventional manner. Most preferably, the polymerization reaction is carried out by the addition of the monomer mix to an aqueous phase which has been preheated to between about 60° C. and about 90° C. and is under agitation. Addition rates may vary and may range from about ½ hour to about 10 hours, with 1 to 6 hours being most preferred. The system is allowed to react for about 1 to about 10 hours before cooling.

The polymeric thickeners are prepared by reacting the previously described monomers and conventional reagents using conventional polymerization techniques. For example, polymers may be prepared from reacting the aforementioned water-soluble monomers using aqueous solution polymerization techniques. Another well-known and well-documented method includes suspension polymerization using the well-known suspending agents. Additionally, the inverse emulsion polymerization process may be employed. Such water-in-oil emulsion polymerization procedures are taught in Vanderhoff et al., U.S. Pat. No. 3,284,393. The preferred method of preparation involves emulsion polymerizing the monomers at a pH of about 1.0 to about 5.0, preferably about 3.0 using free-radical producing initiators, usually in an amount from about 0.01 to about 3 parts based on 100 parts monomers.

Other ingredients well known in the art may be included for various specific purposes. Such additives include buffering agents, inorganic salts and pH adjusting agents. Preferably, chelating reagents are added to remove ferric and other free metal ions, as well as calcium and magnesium ions which interfere with polymerization processes.

The emulsion polymerization of the crosslinking containing monomers, the polyalkeleneoxy-containing monomers the water-soluble monomers and the water-insoluble monomers is optimally carried out under inert atmosphere (i.e., nitrogen) using about 100 to about 1000 parts of a deionized or distilled water solvent preferably treated with a small amount (i.e., less than about 0.01 part based on 100 parts monomers) of chelating agents. Most advantageously, a monomer mix containing 100 parts monomer, about 0 to about 10 parts of chain transfer agent, and 0 to about 10 parts surfactant (preferably nonionic) is added to the aqueous charge. After the reaction is completed and the mixture has cooled, 0 to about 10 parts of a neutralant such as sodium hydroxide, aqueous ammonia or monoisopropanolamine may be added along with stabilizers such as chelating reagents or formaldehyde. Coagulum is removed from the latex/aqueous mixture by filtration using, for example, a 200 mesh screen. Such latex particles are typically in the range of about 200 Å to about 3000 Å in size as determined by disymmetry measurement techniques.

In the practice of preparing the polymer, it is desirable to copolymerize from about 0.01 to about 10, preferably about 0.01 to about 1, weight percent crosslinking monomer; from about 15 to about 75, preferably from about 20 to about 70, weight percent water-soluble monomer; from about 0.5 to about 25, preferably from about 1 to about 20, weight percent polyalkyleneoxy-containing monomer; and from about 15 to about 90, preferably from about 30 to about 80, weight percent water-insoluble monomer. It is understood that the amount of the crosslinking monomer which is employed in preparing the polymerization product of this invention is dependent upon the crosslinking efficiency of the crosslinking monomer which is employed. It is also understood that crosslinking monomers having low crosslinking efficiency are more likely to precipitate out of solution, and are more difficult to handle.

The most preferred polymers are prepared from water-insoluble monomers that, if homopolymerized, would yield a polymer having a low glass transition temperature ($T_g$) (i.e., a $T_g$ of less than about 25° C.). Such monomers will be referred to as "soft" monomers, as opposed to "hard" monomers which, if homopolymerized would yield polymers having $T_g$s greater than about 25° C. It is desirable that the resulting latex particle not have an exceedingly high hydrophobic character in order that the latex particle be swellable and, hence, perform well as a thickener. However, it is also necessary that the latex particles exhibit a sufficiently high hydrophobicity in order that the polymer particles maintain their integrity (i.e., a definite particle character) after swelling has occurred. For example, the desired latex properties can be obtained by increasing the relative amount of the crosslinking monomer and decreasing the relative amount of "hard" monomer which is present in the polymer. Similarly, desired latex properties can be obtained by decreasing the relative amount of the crosslinking monomer and increasing the relative amount of "hard" monomer which is present in the polymer.

High viscosity polymer can be obtained by polymerizing relatively large amounts of "soft" monomer with the water-soluble monomers, polyalkyleneoxy-containing monomers and crosslinking monomers. In addition, an increase in the amount of the crosslinking monomer relative to the other monomers will increase the molecular weight of the copolymer and, hence, the viscosity of the polymer, when small amounts of crosslinking monomer are employed. It is understood, however, that a relatively large amount of crosslinking monomer will ultimately act to reduce the viscosity exhibited by the copolymer particle.

It is also understood that crosslinking to the extent desired may also be provided from a crosslinking impurity in one or more of the monomers, or from a side reaction of one or more of the monomers yielding a water-swellable rather than a water-soluble product, even though no crosslinking monomer is present in the monomer mix.

It is also understood that a sufficient amount of crosslinking under certain circumstances can sufficiently control the degree of swellability of the polymer. Under such circumstances, it is understood that another aspect of the present invention is a substantially oil-free hydraulic fluid or metalworking composition which maintains a Newtonian and shear stable viscosity comprising an aqueous liquid and a substantially water-swellable synthetic addition polymer comprising the reaction product of at least one water-soluble ethylenically unsaturated monomer in an amount sufficient to provide swellability to said polymer, at least one polyalkyleneoxy-containing monomer, and at least one polyvinyl crosslinking monomer in an amount sufficient to control the degree of swellability of said polymer while imparting mechanical reinforcement to said polymer.

The polymer prepared as herein-described is pH responsive, wherein the term "pH responsive" means that the hydrophilicity of the polymer varies with pH. For example, the anionic polymer is substantially less hydrophilic in an aqueous liquid having a pH of less than about 5 than in a neutral or alkaline aqueous liquid. The ability of the polymer to thicken the composition is a result of the aforementioned change in hydrophilicity wherein the polymer is insoluble (i.e., hydrophobic) in an aqueous liquid at one pH, thereby having little or no effect on the viscosity or other properties of the aqueous liquid. At a second pH, the polymer dissolves or swells sufficiently in the aqueous liquid to increase the viscosity of the liquid. Advantageously, the anionic polymer thickeners are essentially insoluble (i.e., preferably forming no more than about a 0.5 weight percent solution) in an aqueous liquid having a pH of less than about 5. Such polymeric thickeners become highly viscous at a pH in the range of about 5 to about 7. Alternatively, in a neutral or alkaline aqueous liquid, the copolymer dissolves or swells extensively in said aqueous liquid. The polymer dissolves or swells sufficiently in an aqueous liquid having a pH of at least about 7, preferably about 7 to about 12. The polymer solution is most preferably employed at a pH in the range of from about 8.5 to about 10.

In the form of a stable, aqueous colloidal dispersion at an acid pH of about 3 to about 6, the polymer is particularly useful. Such an aqueous dispersion may contain about 10 to about 50 weight percent of polymer solids, yet be of relatively low viscosity. Thus, it is readily metered and blended with aqueous product systems. However, the dispersion is typically pH responsive. When the pH of the polymeric dispersion is adjusted by addition of a base such as ammonia, an amine or a nonvolatile inorganic base such as sodium hydroxide, potassium carbonate or the like, the aqueous mixture becomes translucent or transparent as the polymer swells at least partially in the aqueous phase with a concurrent increase in viscosity. This neutralization can occur in situ when the liquid emulsion polymer is blended with an aqueous solution containing a suitable base. If desired for a given application, pH adjustment by partial or complete neutralization can be carried out before or after blending the liquid emulsion polymer with an aqueous product.

The particle size of the polymer (i.e., latex) particles so formed and used herein ranges from less than about 200 Å to about 3000 Å in diameter. The particle size of the latex particles depends upon the method used to prepare said particles and the amount of surfactant that is employed during the preparation of said latex. In particular, the use of smaller amounts of surfactant will yield larger size latexes. Most preferred are those particles of a size in the range of from about 200 Å to about 900 Å. Most preferred are those particles which are small in size in that such particles when employed in preparing the formulations of this invention, yield fluids of highly Newtonian character. It is understood, however, that such smaller size particles, though providing a good Newtonian behavior to said fluids are less efficient thickeners, and thus require a relatively high amount of thickener in the aqueous liquid to obtain the desired viscosity.

The polymers which are prepared by the aforementioned polymerization techniques are useful as thickeners and can have viscosities as high as about 1500 centipoises as measured using a standard Brookfield viscometer as a 1 percent aqueous solution at a pH of about 9.5 and at about 25° C. However, high viscosity thickeners are extremely pseudoplastic and exhibit extremely poor Newtonian behavior. The preferred polymers of this invention exhibit viscosities of less than about 600 centipoises, most preferably less than about 200 centipoises, as measured using a standard Brookfield viscometer as a 5 percent aqueous solution at a pH of about 9.5 and at about 25° C. Such polymers exhibit extremely good Newtonian behavior.

The polymeric thickeners of the present invention are capable of thickening an aqueous liquid to provide the resulting fluid with a viscosity comparable to that of oil-based hydraulic fluids. By the term "thicken" is meant that the viscosity of the liquid is measurably increased upon the addition of the polymer thickener thereto, when said viscosities are measured using conventional techniques such as with a Brookfield viscometer. The specific amount of polymer present as a thickener in aqueous media will depend on a variety of factors including the end use application and the amount and composition of thickener employed.

The polymeric thickeners of the present invention are broadly characterized as crosslinked, swellable latexes. Such latexes have high thickening ability at low concentrations in an aqueous liquid, and maintain their good thickening ability even after prolonged service at high rates of shear. The good shear stability makes the latexes more suitable than either high or low molecular weight linear polymers which are used as thickeners in hydraulic fluid or metalworking applications.

The latex form offers unique opportunities in that a product can be shipped and handled as a low viscosity/-high solids concentrate (i.e., for example, at a low pH). Viscosity is developed when the latex is neutralized with typical components of a high water-based fluid package as alkanolamines of caustic. This product also offers potential waste treatment advantages since the pH can be adjusted to yield an acid pH and the thickener which ultimately precipitates can be filtered out of solution.

The crosslinked latex provides a viscosity to the aqueous liquids which is less dependent on shear rate changes than other typical thickeners (i.e., the crosslinked latex thickeners are more Newtonian in nature). The crosslinked latex also exhibits a viscosity that is highly constant throughout the lifetime of the fluid (i.e., is mechanically stable to shear degradation). Furthermore, the alkali-swellable (i.e., pH responsive) latexes which are manageable when at a low pH, can be mixed with an aqueous liquid and can be neutralized with a base to yield a good thickener.

The hydraulic fluids and metalworking compositions of the invention comprise a functionally effective amount of a polymeric thickener formulated with an aqueous liquid to give the desired balance of properties for the desired application. Said fluids and compositions generally comprise from about 85 percent to about 99.9 weight percent aqueous liquid and from about 0.1 percent to about 15 weight percent polymeric thickener. These aqueous liquids comprise water and additives such as other thickening agents, defoamers, corrosion inhibitors and metal deactivators or chelating agents. Preferably, said formulations comprise about 0.5 to about 10 weight percent polymeric thickener and about 90 to about 99.5 percent aqueous liquid. The fluids are easily formulated at room temperature using distilled or deionized water although tap water can also be used without adverse effects on the fluid properties.

Additives common to hydraulic or metalworking fluids may be added to the thickened compositions without hindering the desired properties of the hydraulic fluid or metalworking composition. For example, small amounts of corrosion inhibitors such as alkali metal nitrites, nitrates, phosphates, silicates and benzoates may be added as liquid-vapor phase corrosion inhibitors. Representative suitable organic inhibitors include hydrocarbyl amine and hydroxy-substituted hydrocarbyl amine neutralized acid compound, such as neutralized phosphates and hydrocarbyl phosphate esters, neutralized fatty acids (e.g., those having 8 to about 22 carbon atoms), neutralized aromatic carboxylic acids (e.g., 4-(t-butyl)benzoic acid), neutralized naphthenic acids and neutralized hydrocarbyl sulfonates. Mixed salt esters of alkylated succinimides are also useful. Particularly useful amines include the alkanolamines such as ethanolamine, diethanolamine, triethanolamine and the corresponding propanolamines. Other amine-type corrosion inhibitors are morpholine, ethylenediamine, N,N-diethylethanolamine, alpha- and gamma-picoline, piperazine and isopropylaminoethanol. Other additives include colorants; dyes; deodorants such as citronella; bacteriacides and other antimicrobials; water softeners such as an ethylene diamino tetraacetate sodium salt or nitrilo triacetic acid; antifreeze agents such as ethylene glycol and analogous polyoxyalkylene polyols; anti-foamants such as silicone-containing agents and shear stabilizing agents such as commercially available polyoxyalkylene polyols. Antiwear agents, friction modifiers, anti-slip and lubricity agents may also be added. Such agents include metal or amine salts of an organo sulfur, phosphorus, boron or carboxylic acid which is the same as or of the type as used in oil-based fluids. Typical of such salts are carboxylic acids of 1 to 22 carbon atoms including both aromatic and aliphatic acids; sulfur acids such as alkyl and aromatic sulfonic acids and the like; phosphorus acids such as phosphoric acid, phosphorous acid, phosphinic acid, acid phosphate esters, and analogous sulfur homologs such as the thiophosphoric and dithiophosphoric acid and related acid esters; mercaptobenzothiozole; boron acids include boric acid, acid borates and the like. Useful functional additives also include lubricity aids such as metal dithiocarbamates including molybdenum and antimony dithiocarbamates; as well as dibutyltin sulfide, tributyltin oxide, phosphates and phosphites; borate amine salts, chlorinated waxes; trialkyltin oxide, molybdenum phosphates and chlorinated waxes. Extreme pressure additives include phosphate esters and zinc dialkyl dithiophosphate.

It should also be noted that many of the ingredients described above for use in making the substantially oil-free hydraulic fluids and metalworking compositions of this invention are industrial products which impart more than one property to the composition. Thus, a single ingredient can provide several functions thereby eliminating or reducing the need for some other additional ingredient. Thus, for example, a dispersing agent may also serve in part as an inhibitor of corrosion. Similarly, it may also serve as a neutralizing agent to adjust pH or as a buffer to maintain pH. Similarly, a lubricity agent such as tributyltin oxide can also function as a bactericide. In addition, lauric acid, when employed in small amounts as a lubricity aid, may also act as as a viscosity enhancing agent.

The hydraulic fluid and metalworking compositions of this invention, when formulated as taught above, are transparent or slightly turbid liquids having a viscosity of up to about 1500 centipoises at 100° F., which are stable over long periods of storage at ambient temperature. Most preferably, hydraulic fluids and metalworking compositions of this invention are formulated such that the viscosity is between about 10 and about 100 centipoises at 100° F. In addition, the hydraulic fluids and metalworking additives of the invention are substantially oil-free and will not support combustion in contrast to petroleum oils. The hydraulic fluids and metalworking additives of the invention are ecologically clean and nonpolluting compositions when compared to existing petroleum-based hydraulic fluids. Since the hydraulic fluids and metalworking additives of the invention are largely based upon materials which are not derived from petroleum, the production of such fluids is relatively independent of shortages of petroleum oil and not materially influenced by the economic impact of such shortages.

The hydraulic fluids of the invention can be used in various applications requiring hydraulic pressures in the range of up to about 2,000 pounds per square inch since they have all the essential properties such as lubricity, viscosity and corrosion protection. The hydraulic fluids of the invention are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators and other machinery or for closing dies in die-casting machines and in injection molding equipment and other applications.

The hydraulic fluids and metalworking compositions of the present invention can be used in methods for shaping solid material with a work tool by lubricating the tool and/or the material. These shaping processes comprise cutting, grinding, drilling, punching, stamping, turning, lapping, polishing, rolling, drawing and combinations of said processes. Often the solid material is a metal work piece or it may be earth, rock, sand, concrete or a mixture of these. When the work piece is metal, it can comprise at least one ferrous or at least one nonferrous metal or a combination of both. When the material is earth, rock, sand, concrete, cement or a mixture of these, the tool is often a drill of rotary or precussion-type and the earth, rock, sand, concrete, cement or a mixture of same, overlies a naturally occuring deposit, such as a deposit of fossil fuel, an ore body, or an economically valuable mineral such as gem stones and the like.

The following examples are given to further illustrate the invention and should not be considered as limiting the scope thereof. All percentages are in weight percent unless otherwise noted.

EXAMPLE 1

A 500-ml capacity, round-bottom flask equipped with a pulse feeder pump for delivering monomer, an agitation means and a reflux condenser is charged with 195 g of deionized water. The charge is purged with nitrogen and preheated to 75° C. To the charge is added 50 mg of sodium persulfate and 3.75 g of a 10 percent sodium lauryl sulfate solution. A 27-g monomer mix is prepared and is continuously added to the aqueous charge while under nitrogen for a 40-minute period. The monomer mix comprises 0.11 g of allyl methacrylate, 5 g of decaethyleneglycol monomethacrylate, 3.52 g of methacrylic acid and 18.37 g of ethylacrylate. The system is continuously stirred and maintained at about 75° C. for an additional 3 hours in order to complete the reaction. The system is cooled to room temperature and filtered with a 200 mesh screen. The particle size of the latex particles so formed is 370 Å as determined by disymmetry measurements.

The latex so prepared is added to deionized water to yield a 4.5 percent latex formulation. Said formulation also contains 1 percent lauric acid, 500 ppm antifoam formulation and enough sodium hydroxide to yield a pH of about 9.5. This sample is designated as Sample No. 1.

In a like manner is prepared a formulation comprising 4 percent latex and about 96 percent deionized water. The pH of the formulation is adjusted to about 9.5. This sample is designated as Sample No. 2.

Viscosities of the two samples are measured at various shear rates using a Haake NV system at 40° C. Results are presented in Table I.

TABLE I

| Sample No. | Shear Rate (sec) | Viscosity (cps) |
|---|---|---|
| 1 | 173 | 26.5 |
| | 345 | 25.6 |
| | 690 | 26.3 |
| 2 | 173 | 21.0 |
| | 345 | 20.5 |
| | 690 | 20.0 |

The data indicates good thickening efficiency without sacrificing Newtonian behavior.

EXAMPLE 2

Wear values for Sample No. 1 are obtained using a Falex simulated vane pump test on a Falex Model 6 Friction and Wear tester. Wear values are also obtained for two commercially available hydraulic fluids. Results are presented in Table II.

TABLE II

| Sample No. | Wear[1] (mg) |
|---|---|
| 1 | 21 |
| C-1* | 22 |
| C-2* | 24 |

*Not an example of the invention.
[1]Wear data is presented in milligram wear after samples are tested at 50° C. under 500 lbs. load, at 1000 rpm for 100 minutes.

The data indicates low wear of Sample No. 1 when employed under conventional hydraulic fluid conditions as compared to conventional commercially available high water based hydraulic fluids. The thickening ability of Sample No. 1 is at least as good as that of the commercially available fluids.

What is claimed is:

1. A substantially oil-free hydraulic fluid or metalworking composition which maintains a Newtonian and shear stable viscosity comprising an aqueous liquid and a substantially water-swellable synthetic addition polymer comprising the reaction product of (1) at least one water-soluble ethylenically unsaturated monomer in an amount sufficient to provide swellability to said polymer, (2) at least one water-insoluble ethylenically unsaturated monomer in an amount sufficient to control the degree of swellability of said polymer, (3) at least one ethylenically unsaturated polyalkyleneoxy-containing monomer in an amount sufficient to impart thickening efficiency to the polymer at high shear rates while not suffering significant deformation, and (4) at least one polyvinyl crosslinking monomer in an amount sufficient to control the degree of swellability of said copolymer while imparting mechanical reinforcement to said polymer.

2. A substantially oil-free hydraulic fluid or metalworking composition of claim 1 comprising about 85 to about 99.9 weight percent of an aqueous liquid and about 0.1 to about 15 weight percent of a water-swellable synthetic addition copolymer comprising (1) about 0.01 to about 10 weight percent of said polyvinyl crosslinking monomer, (2) about 15 to about 75 weight percent of said water-soluble ethylenically unsaturated monomer, (3) about 15 to about 95 weight percent of said ethylenically unsaturated water-insoluble monomer, and (4) about 0.5 to about 25 weight percent of said ethylenically unsaturated polyalkyleneoxy-containing monomer.

3. A substantially oil-free hydraulic fluid or metalworking composition of claim 1 comprising about 85 to about 99.9 weight percent of an aqueous liquid and about 0.1 to about 15 weight percent of a water-swellable synthetic addition polymer consisting essentially of (1) about 0.01 to about 1 weight percent of said polyvinyl crosslinking monomer, (2) about 20 to about 70 weight percent of said water-soluble ethylenically unsaturated monomer, (3) about 30 to about 80 weight percent of said ethylenically unsaturated water-insoluble monomer, and (4) about 1 to about 10 weight percent of said ethylenically unsaturated polyalkyleneoxy-containing monomer.

4. A hydraulic fluid or metalworking composition of claim 3 comprising about 90 to about 99 weight percent aqueous liquid and about 1 to about 10 weight percent of said water-swellable synthetic addition polymer.

5. A hydraulic fluid or metalworking composition of claim 1 having a pH of at least about 7.

6. A hydraulic fluid or metalworking composition of claim 1 wherein said water-soluble monomer is a member selected from the group consisting of acrylic acid, methacrylic acid, acrylamide, maleic anhydride, methacrylamide and dimethyl aminoethyl methacrylate.

7. A hydraulic fluid or metalworking composition of claim 1 wherein said water-insoluble ethylenically unsaturated monomer is a member selected from the group consisting of styrene, α-methyl styrene, methylacrylate, butylacrylate, ethylacrylate, methylmethacrylate, ethylmethacrylate, acrylonitrile, methacrylonitrile, vinyl chloride and vinylidene chloride.

8. A hydraulic fluid or metalworking composition of claim 1 wherein said crosslinking monomer is a member selected from the group consisting of allyl acrylate and allyl methacrylate, N,N'-methylene diacrylamide and divinylbenzene.

9. A hydraulic fluid or metalworking composition of claim 1 wherein said polyalkyleneoxy-containing monomer is:

$$Y^1(OCH_2CH_2)_nOC(=O)-C(R^1)=CHR$$

wherein R and $R^1$ are H or $CH_3$; $Y^1$ is hydrogen or an alkyl containing between 1 and about 9 carbon atoms, and n is about 4 to about 100.

10. A hydraulic fluid or metalworking composition of claim 1 wherein said polyalkyleneoxy-containing monomer is:

$$CH_2=C(R^1)-C(=O)-N(H)-R^5-(R^3O)_n-R^4$$

wherein $R^1$ is hydrogen or methyl, $R^5$ is $-CH_2-$, $R^3$ is ethylene, $R^4$ is hydrogen or alkyl or branched alkyl containing between 1 and about 8 carbon atoms, and n is about 5 to about 100.

11. A hydraulic fluid or metalworking composition of claim 1 wherein said synthetic addition copolymer comprises (1) about 0.4 weight percent allyl methacrylate, (2) about 68 weight percent ethylacrylate, (3) about 13.1 weight percent methacrylic acid, and (4) about 18.5 weight percent decaethyleneglycol monomethacrylate.

12. A hydraulic fluid or metalworking composition of claim 1 wherein said aqueous liquid contains an antifoaming agent.

13. A hydraulic fluid or metalworking composition of claim 1 wherein said aqueous liquid contains a lubricity aid.

14. A hydraulic fluid or metalworking composition of claim 1 wherein said aqueous liquid contains a corrosion inhibitor.

15. A hydraulic fluid or metalworking composition of claim 1 wherein said aqueous liquid contains an extreme pressure additive.

* * * * *